US005393497A

United States Patent [19]

Haber et al.

[11] Patent Number: 5,393,497

[45] Date of Patent: Feb. 28, 1995

[54] DEVICE FOR CONTAINING AND OPENING A GLASS AMPULE AND FOR TRANSFERRING LIQUID WITHIN THE AMPULE TO A CONTAINER

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[21] Appl. No.: 187,369

[22] Filed: Jan. 24, 1994

Related U.S. Application Data

[63] Continuation of Ser. No. 948,290, Sep. 21, 1992, abandoned.

[51] Int. Cl.[6] ..... B65D 1/09; B65D 83/00; B65D 83/35; B65D 83/42

[52] U.S. Cl. ..... 422/103; 422/99; 73/864.82; 137/68.1; 206/219; 206/416; 206/438; 206/528; 206/532; 604/82; 604/83; 604/87

[58] Field of Search ..... 73/864.82; 137/68.1; 206/528, 532, 219, 446, 438; 604/82, 83, 87; 422/103, 99

[56] References Cited

U.S. PATENT DOCUMENTS

| | | | |
|---|---|---|---|
| 2,609,818 | 9/1952 | Parrine | 604/148 |
| 3,040,743 | 6/1962 | Naess | 604/148 |
| 3,506,006 | 4/1970 | Lange, Jr. | 604/190 |
| 3,563,373 | 2/1971 | Paulson | 206/229 |
| 3,892,237 | 7/1975 | Steiner | 604/200 |
| 4,303,069 | 12/1981 | Cohen | 604/201 |
| 4,732,850 | 3/1988 | Brown et al. | 206/219 |
| 4,779,763 | 10/1988 | Klaurtter | 206/219 |
| 4,861,335 | 8/1989 | Reynolds | 604/88 |
| 4,958,622 | 9/1990 | Selenke | 604/192 |
| 5,067,948 | 11/1991 | Halber et al. | 604/192 |

*Primary Examiner*—James C. Housel
*Assistant Examiner*—Rachel Freed
*Attorney, Agent, or Firm*—Townsend & Townsend Khourie & Crew

[57] ABSTRACT

A device (2) used to transfer the liquid contents (156) of a glass ampule (8) to a vial (10) includes a telescoping ampule body (12, 14) defining a collapsible, substantially air-tight region (22) within which the ampule is housed, which collapses when one part (12) is threaded onto the other part (14). This collapse increases the pressure within the collapsible region housing the ampule. The ampule is broken within the region, such as at the end of the collapsing of the telescoping members by snapping off the tip (64) of the ampule and breaking the base (48, 53) of the ampule. When used with a vial, a vial (10) is mounted to the ampule body via a vial body (80, 92). A vial spike (120) passes through the vial septum (128). The ampule body and the vial body defines a flow path (74, 100) between the vial spike and the ampule region. Once the flow path is open, the liquid from the ampule within the region flows along the flow path and into the vial because of the pressure created within the region.

23 Claims, 9 Drawing Sheets

DEVICE FOR CONTAINING AND OPENING A GLASS AMPULE AND FOR TRANSFERRING LIQUID WITHIN THE AMPULE TO A CONTAINER

This is a continuation of application Ser. No. 07/948,290, filed Sep. 21, 1992, now abandoned.

BACKGROUND OF THE INVENTION

Glass ampules are widely used for containing pharmaceuticals. Glass ampules typically have a cylindrical base, a narrowed-down neck and a tapered tip. Glass ampules are used to hold pharmaceuticals to eliminate contamination of the pharmaceutical by contact with anything but glass. However, to gain access to the pharmaceutical within the ampule, the user needs to break the ampule. This is accomplished by applying a lateral force on the tip which snaps the ampule at the neck, thus severing the tip from the base of the ampule. The health care worker then inserts the tip of a needle of a syringe into the open ampule and withdraws a desired amount of pharmaceutical from the ampule.

One of the obvious problems with this system is that fine glass fragments can be withdrawn into the syringe. One way to prevent this is to use a needle having a filter. After withdrawing the pharmaceutical into the barrel of the syringe, the filter needle is then replaced with a conventional needle and the injection can be given. This, of course, creates an extra step, increases the chance of a needle stick and increases the cost of the injection.

Another problem with ampules is that they are a single-use container. That is, once the ampule is opened it cannot be resealed for later use. To get around this, vials are often used to contain a pharmaceutical. Vials are commonly cylindrical containers having an end covered by a pierceable, self-sealing elastomeric material, generally referred to as a septum. To remove a portion of the contents of a vial, the health care worker typically inverts the vial so that the septum faces down, inserts a sterile needle cannula of a syringe through the septum, injects some air into the vial to create a positive pressure in the vial and then withdraws the desired amount of liquid pharmaceutical from the vial into the syringe. The needle is then removed from the septum which automatically reseals itself to keep the contents free from contamination for later use.

Certain pharmaceuticals are stored as two separate components for maximum efficacy and shelf life. One such pharmaceutical is human growth hormone, often referred to as hGH. hGH is generally distributed in a lyophilized form. The lyophilized hGH is then mixed with a diluent prior to use. This is commonly accomplished in the following manner. The ampule is broken open and the tip is discarded. The contents of the ampule are drawn into a transfer syringe through a filter needle. The filter needle is replaced with a fresh needle, preferably another filter needle. The septum of the vial containing the lyophilized hGH is pierced with the needle, the contents of the transfer syringe are injected into the vial and then the needle is withdrawn from the vial septum. The contents of the vial are then accessed in a conventional manner using an injection syringe.

SUMMARY OF THE INVENTION

The present invention provides a simple, convenient way to transfer liquid from a glass ampule to a container, such as a vial, in a manner which can help reduce errors in the amount of liquid transferred to the container, which is more sterile, quicker and easier than in the past.

The device includes an ampule body defining a collapsible, substantially air-tight ampule region within which the ampule is housed. The ampule body is preferably a telescoping body which collapses when one part is threaded onto the other part. This collapse of the telescoping members increases the pressure within the region housing the ampule. The ampule body is broken within the ampule region. This typically occurs at the end of the collapsing of the telescoping members by snapping off the tip of the ampule and breaking the base of the ampule.

When the device is used with a vial as the container, the device includes a vial body mounted to the ampule body. A vial is mounted to a vial body and has a vial spike passing through the septum of the vial. The ampule body and the vial body defines a flow path between the vial spike and the ampule region. Once the flow path is open, the liquid from the ampule within the ampule region flows along the flow path and into the vial because of the elevated pressure created within the ampule region.

A final movement of the telescoping parts of the ampule body is preferably accomplished using a threaded connection. Through this rotary movement the tip of the ampule can be engaged by an eccentric member mounted to one of the telescoping parts which provides a lateral force to the tip, thus causing the tip to break away from the base of the ampule. Also, during the final telescoping movement of the two parts, the base of the ampule can be broken by driving the base of the ampule onto a post extending from the other of the telescoping parts.

The flow path between the ampule region in the ampule body and the interior of the vial preferably has a one-way check valve to permit fluid flow to pass from the ampule region into the vial but not the reverse. Also, a syringe access device can be used to permit fluid access to a position along the flow path between the check valve and the vial. This permits the user to withdraw a pharmaceutical within the vial without removing the vial from the device.

Other features and advantages of the invention will appear from the following description in which the preferred embodiment has been set forth in detail in conjunction with the accompanying drawings.

DESCRIPTION OF THE PREFERRED EMBODIMENT

Figure 4:
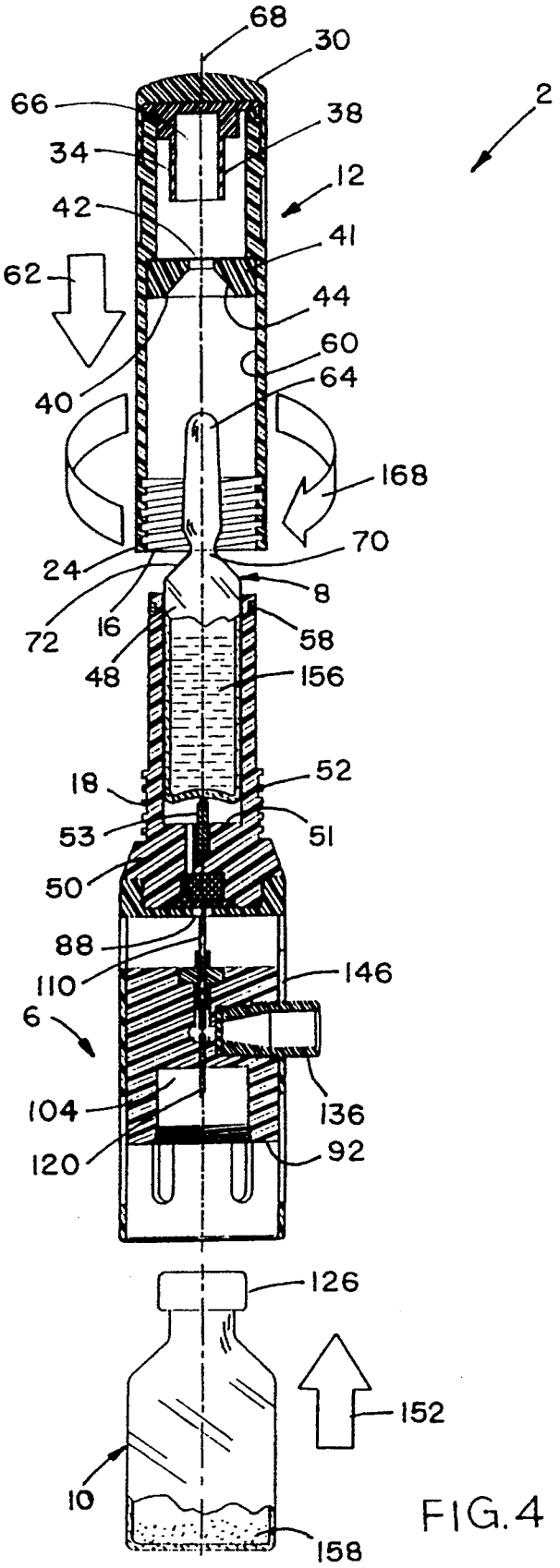
FIG. 4 shows the device of FIG. 3 with the twist barrel assembly separated from the ampule housing, a conventional glass ampule mounted within the ampule housing and a conventional vial shown prior to being mounted to the vial body.

Device 2 includes broadly an ampule body 4 mounted to a vial body 6. Device 2, as shown in FIG. 4, is used with a conventional glass ampule 8 and a conventional vial 10.

Referring now primarily to FIGS. 1–4, ampule body 4 includes a twist barrel assembly 12 which is threadably mounted to an ampule housing 14 through the engagement of internal and external threads 16, 18. Twist barrel assembly 12 includes a hollow twist barrel 20 defining an ampule region 22 therein. Internal threads 16 are formed at one end 24 of twist barrel 20. The other end 26 of twist barrel 20 has external threads 28 formed thereon. A cap 30 is secured to end 26 using threads 28 and captures an elastomeric seal washer 32 and an eccentric element 34 therebetween. Eccentric element 34 includes a disk-like portion 36, positioned between the interior surface of cap 30 and seal washer 32, and a hollow eccentric cylinder portion 38 which extends into region 22. A press ring 40 is positioned within region 22 adjacent a shoulder 41 between internal threads 16 and cylindrical portion 38. Press ring 40 has a central opening 42 defined in part by a conical surface 44 facing end 24.

Figure 5:
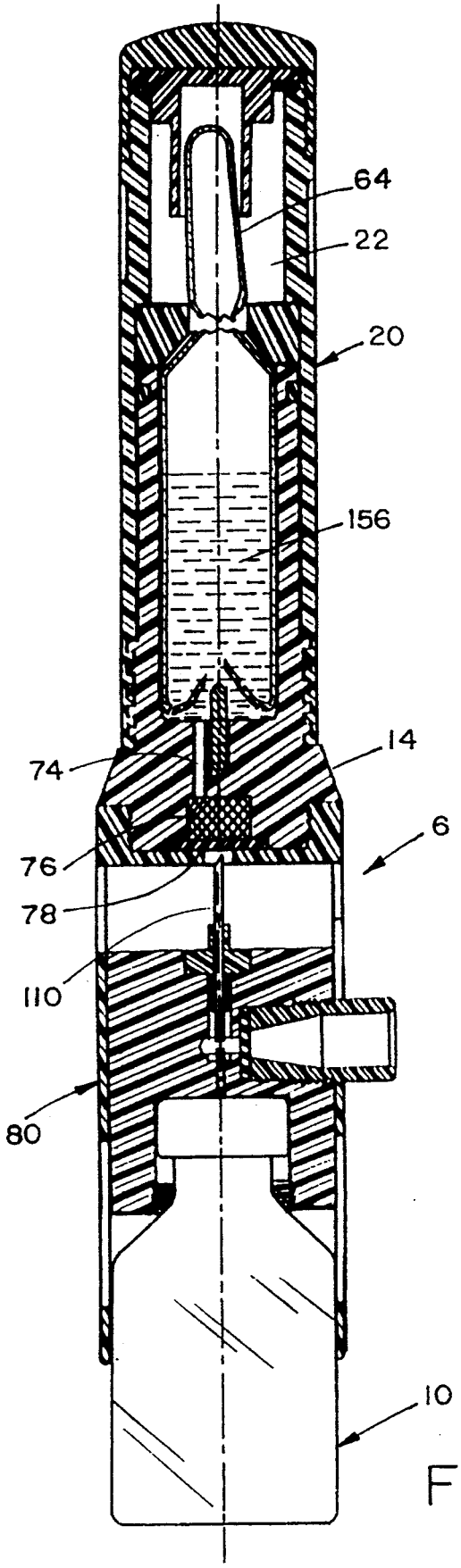
FIG. 5 shows the device, ampule and vial of FIG. 4 after the two telescoping members, that is the twist barrel assembly and the ampule housing, have been moved from their extended position to their collapsed position, thus snapping off the tip of the ampule and breaking the base of the ampule, and also showing the vial mounted within the vial body with the vial spike passing through the septum of the vial.

Ampule housing 14 has an open interior 46 housing the base 48 of ampule 8. A post 50 extends from the base 51 of ampule housing 14 at the closed end 52 of open interior 46 so as to contact the center of the bottom 53 of ampule base 48. Housing 14 includes an external groove 54 at its open end 56 which houses an O-ring 58. O-ring 58 engages a cylindrical bore surface 60 partially defining region 22 after open end 56 passes internal threads 16. This causes region 22 to become pressurized since once O-ring 58 passes threads 16, ampule region 22 is substantially air tight. Continued movement of twist barrel assembly 12 in the direction of arrow 62 continues to increase the pressure within region 22. The final movement of twist barrel assembly 12 in the direction of arrow 62 occurs through the engagement of threads 16, 18. When this occurs, the tip 64 of ampule 8, having passed through central bore 42, enters interior 66 of cylindrical portion 38 of eccentric element 34. However, cylindrical portion 38 is offset or eccentric of the center line 68 of the device so that continued rotation of twist barrel assembly onto ampule housing 14 creates a lateral or sideways force on tip 64, thus snapping tip 64 from base 48 at the neck 70 of ampule 8. This is illustrated in FIG. 5. Also, continued movement of twist barrel assembly 12 in the direction of arrow 62 causes conical surface 44 of press ring 40 to press axially against the shoulder 72 of ampule 8, thus driving bottom 53 of base 48 onto post 50, causing base 48 to break as shown in FIG. 5.

Ampule housing 14 defines a pathway 74, see FIG. 5, extending from end 52. Pathway 74 is sized to house a filter 76 and an elastomeric ampule housing septum 78. Pathway 74 is normally sealed by septum 78 when ampule housing 14 is mounted to a vial housing 80 using threads 82, 84 formed on ampule housing 14 and vial housing 80, respectively. Vial housing 80 includes a bulkhead 86 having a central bore 88 formed therein. Septum 78 is squeezed between ampule housing 14 and bulkhead 86 so as to provide a seal against the passage of fluid along pathway 74.

Vial housing 80 has a substantially open interior 90 within which a vial cup 92 is slidably mounted. Twist barrel 20 has blind slots 94 and vial housing 80 has through slots 96, 98 formed therein. Slots 94, 96, 98 are used to provide a good gripping surface for the user when moving twist barrel assembly 12 from the extended position of FIG. 4 to the collapsed position of FIG. 5.

Figure 1:
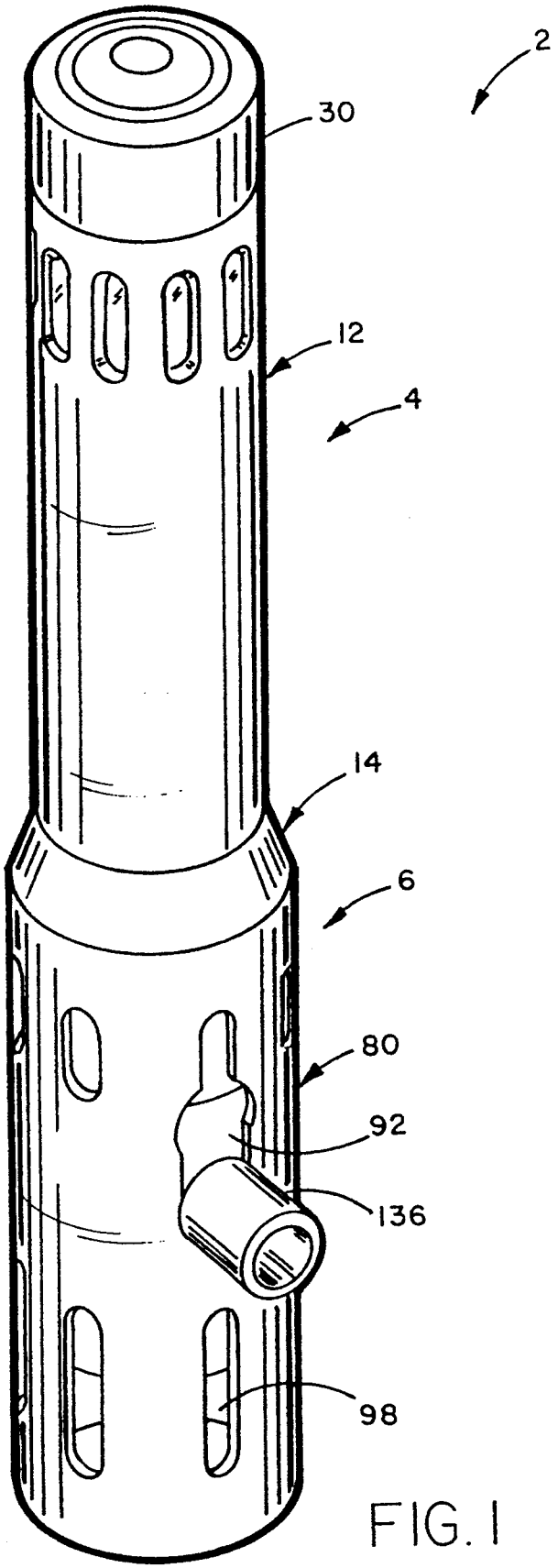
FIG. 1 is an enlarged perspective view showing a device made according to the invention in an assembled form but without a vial or an ampule mounted to it.
Figure 2:
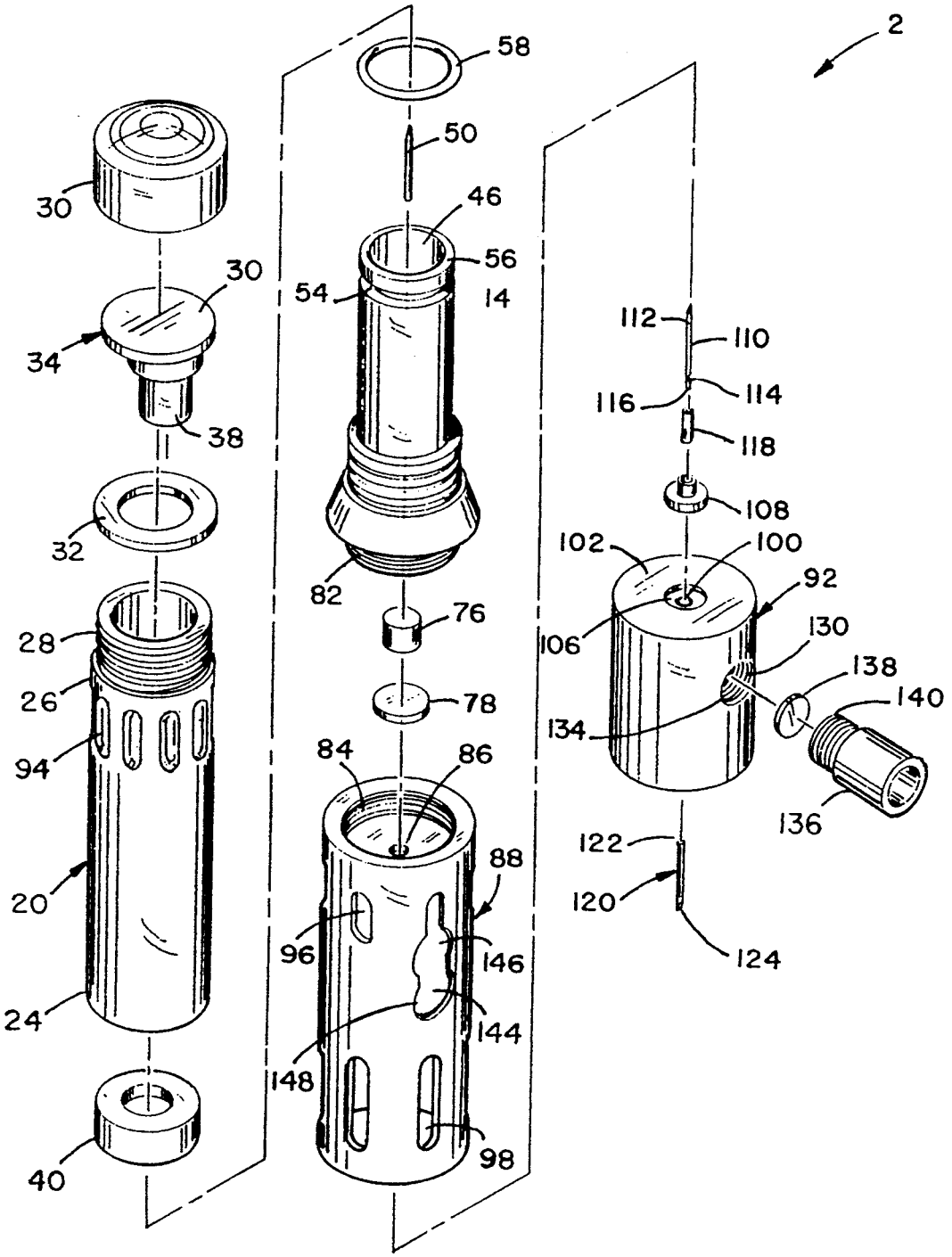
FIG. 2 is an exploded isometric view of the device of FIG. 1 without either an ampule or a vial.
Figure 3:
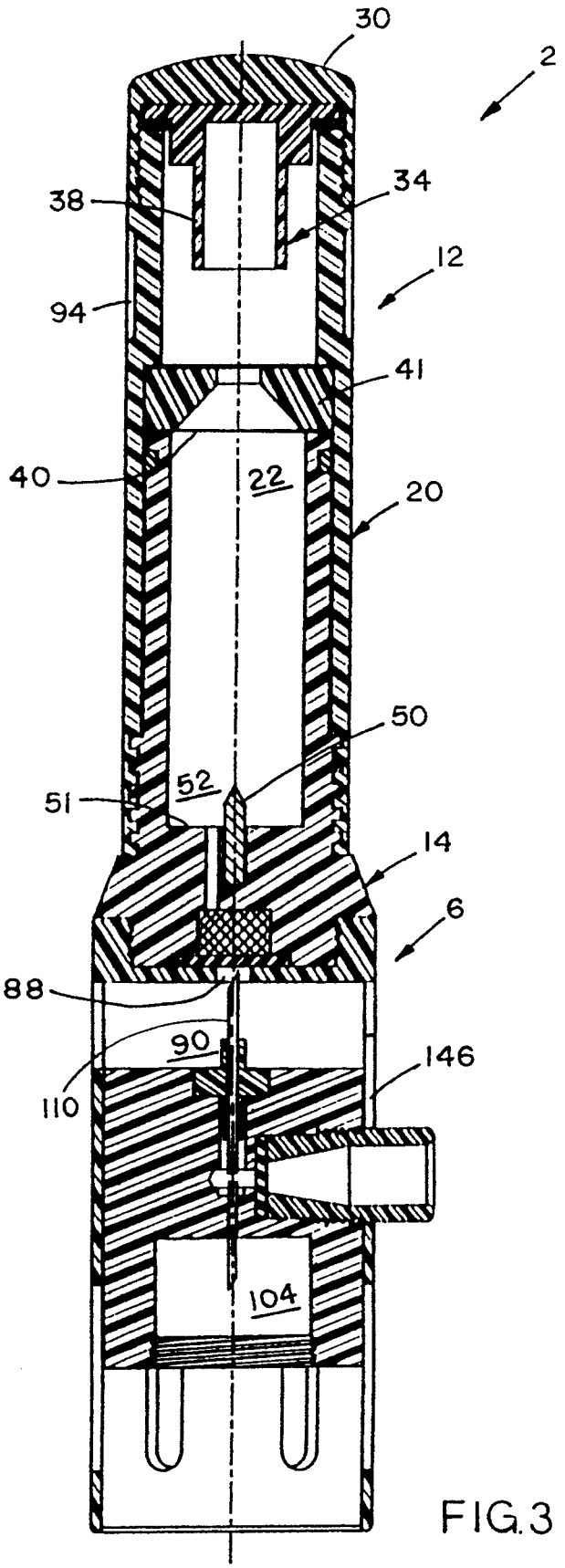
FIG. 3 is a cross-sectional view of the device of FIG. 1.
Figure 7:
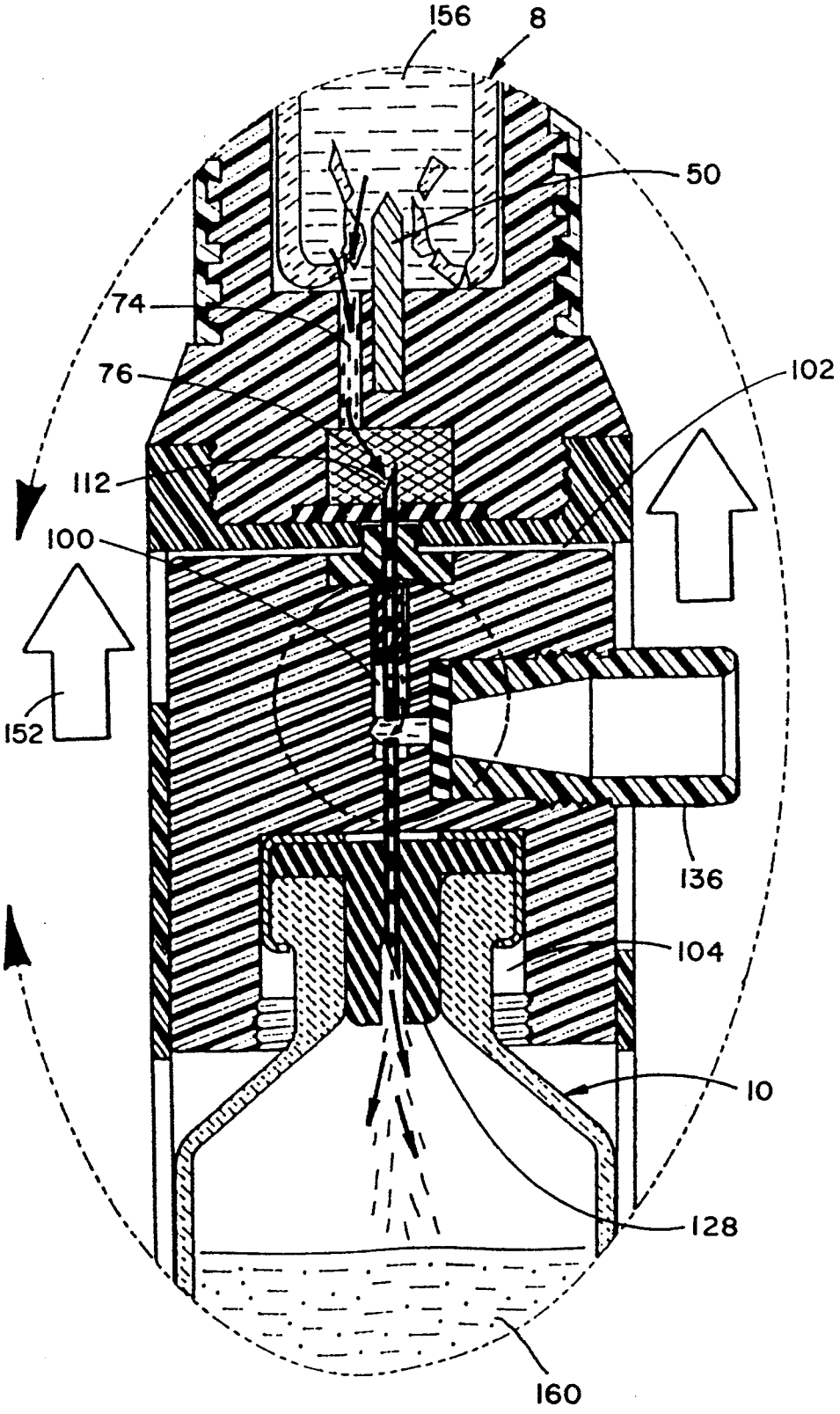
FIG. 7 is an enlarged view of a portion of FIG. 6 taken along line 7—7.

Vial cup 92, as seen best in FIGS. 2 and 7, has a bore 100 extending from one end 102 of vial cup 92 to a recessed region 104, shown best in FIG. 4. Bore 100 has a countersunk end 106 which houses a spike support 108. Spike support 108 supports a hollow valve spike 110 having sharpened tip 112 adapted to pierce septum 78. Valve spike 110 has one opening at tip 112 and a side opening 114 adjacent end 116. See FIG. 7A. End 116 itself is sealed. Side opening 114 is covered by a cylindrical flap of flexible material 118 which acts as a check valve as is discussed below.

A hollow vial spike 120 is mounted within bore 100 with its open entrance end 122 opposite end 116 of valve spike 110 and its open, sharpened vial end 124 extending into recessed region 104. Vial 10 is mounted to vial cup 92 by inserting the top 126 of vial 10 into region 104 so that vial spike 120 pierces septum 128 of vial 10. The friction between vial spike 120 and septum 128 is sufficient to keep vial 10 mounted within vial cup 92.

Vial cup 92 includes a lateral bore 130 which intersects bore 100 at a common region 132. Lateral bore 130 has a threaded outer end 134. A threaded, hollow septum retainer 136 is mounted within lateral bore 130 and captures a syringe septum 138 between the end 140 of septum retainer 136 and a shoulder 142 within lateral bore 130 adjacent common region 132. Septum 138 thus normally seals lateral bore 130.

Septum retainer 136 passes through an axially extending, keyhole-shaped opening 144 in vial housing 80. Opening 144 has a narrowed region 146 which acts as a detent to keep septum retainer 136 at either end 148, 150 of opening 144 in vial housing 80.

Figure 6:
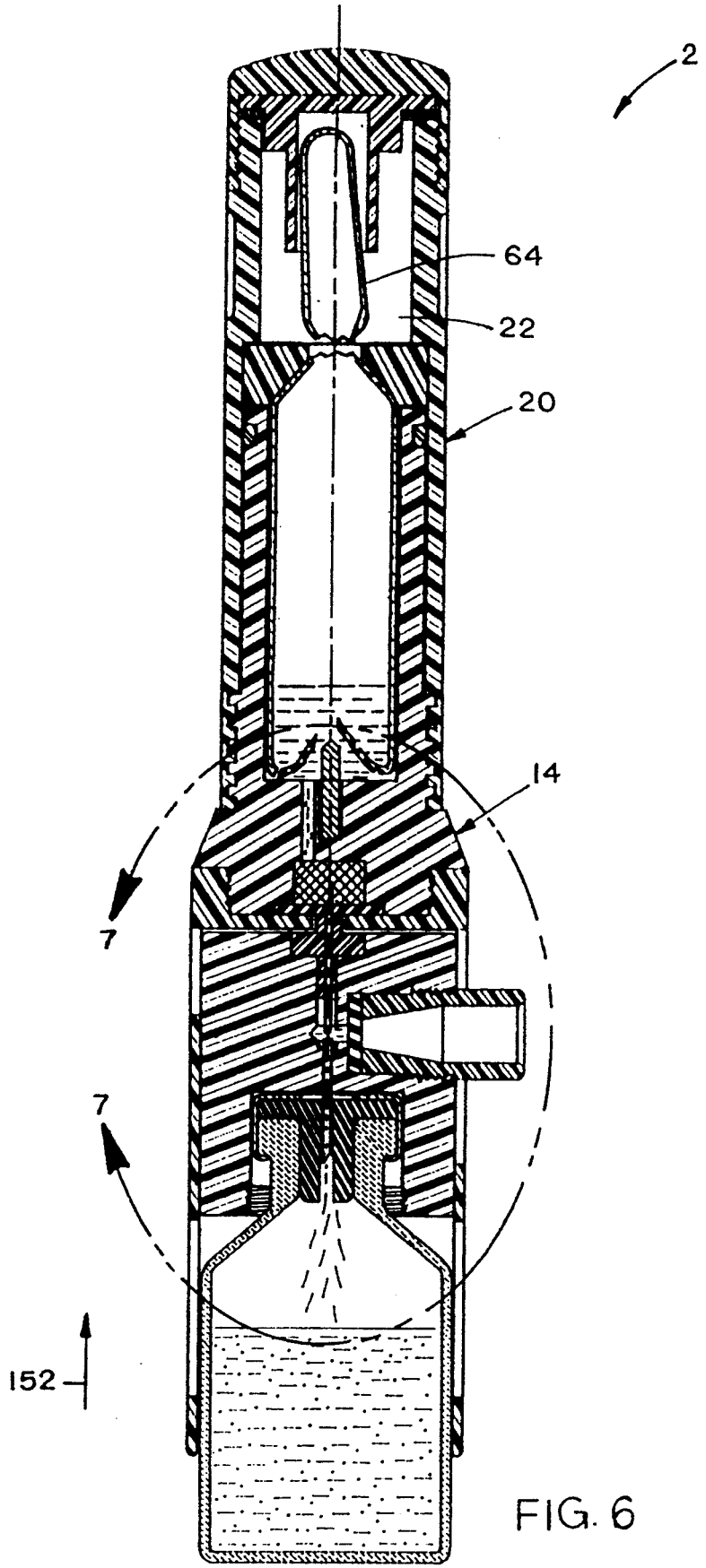
FIG. 6 illustrates the device of FIG. 5 after having moved the vial cup and vial from the position of FIG. 5 to the position of FIG. 6, that is towards the ampule, thus causing the valve spike to pass through the ampule housing septum and into the filter, thus completing the flow path between the region housing the ampule and the interior of the vial so that the liquid within the region passes along the flow path and into the vial, thus mixing with the lyophilized pharmaceutical in the vial.
Figure 7A:
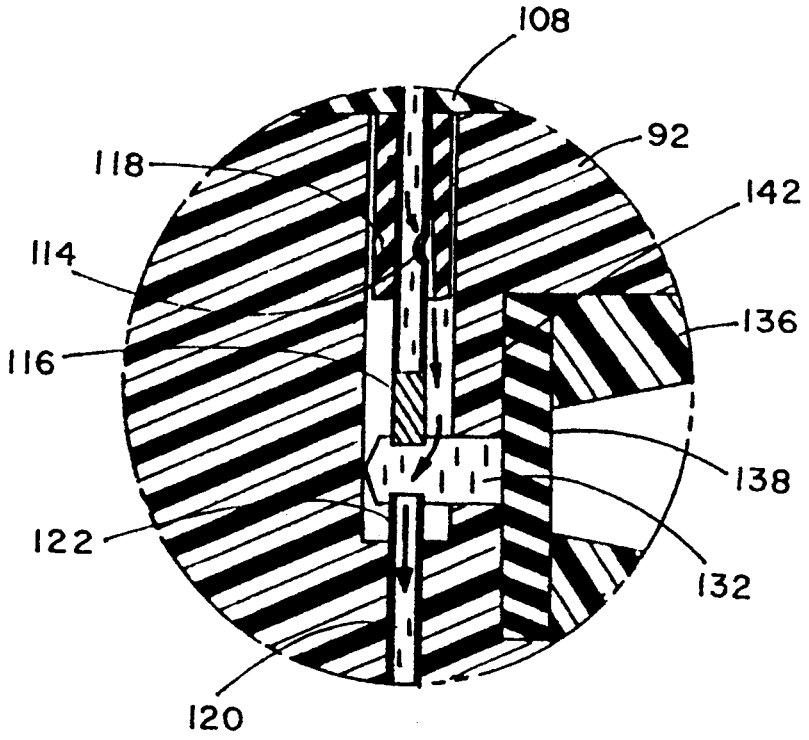
FIG. 7A is an enlarged view of a portion of the valve spike of FIG. 7 illustrating the one-way valve along the flow path in an open orientation.

FIG. 5 shows septum retainer 136 within end 148 of opening 144 with sharpened tip 112, that is the septum end of hollow valve spike 110, opposite but not piercing septum 78. Moving vial 10 and vial cup 92 in the direction of arrow 152 causes septum retainer 136 to move into end 150 of opening 144 and also causes vial spike 110 to pierce septum 78, thus opening a fluid pathway from ampule region 22, along pathway 74, through valve spike 110, along bore 100, through vial spike 120 and into the interior 154 of vial 10. This fluid movement is illustrated in FIGS. 6, 7 and 7A. This occurs automatically due to the pressurization of region 22. The degree of pressurization determines how much of the liquid 156 in ampule 8 is driven into vial 10. As shown in FIG. 7A, flap 118 opens to permit the fluid flow in the direction indicated in FIG. 7 from ampule 8 to vial 10. Any particles of glass from the broken ampule should be caught by filter 76 so that liquid 156, when entering interior 154 of vial 10, is essentially free from solid contaminants.

Figure 8:
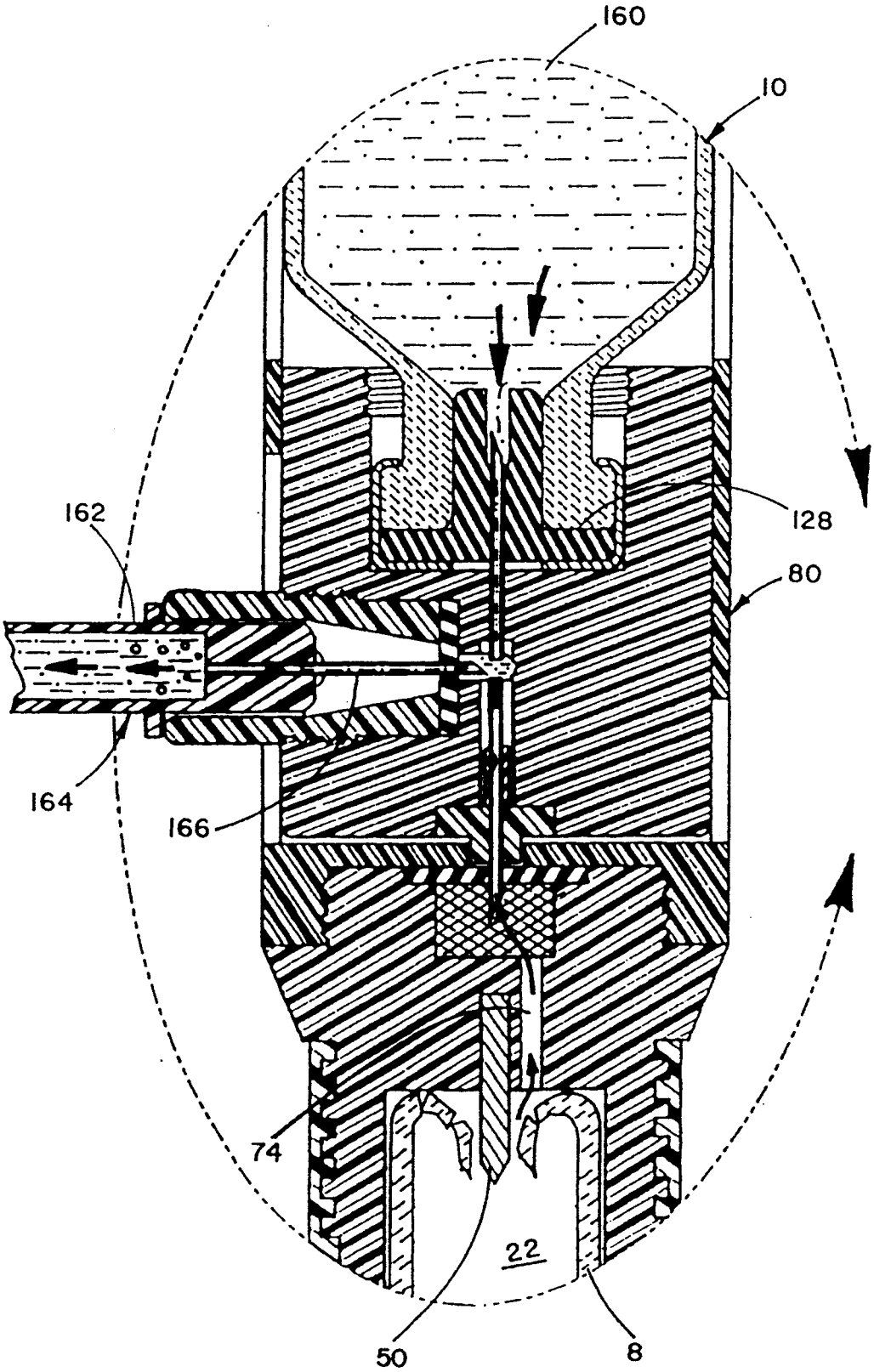
FIG. 8 is a view similar to FIG. 7 but with the device turned upside down and having the needle end of a syringe mounted to the syringe access device carried by the vial cup with the tip of the needle cannula of the syringe passing through the syringe septum for fluid access to the interior of the vial such that the content of the vial can be withdrawn into the syringe through the vial spike and needle cannula.

Vial 10 typically includes a second pharmaceutical component, such as lyophilized human growth hormone (hGH) 158. As shown in FIG. 8, the needle end 162 of a syringe 164 is inserted into septum retainer 136 so that the needle cannula 164 passes through syringe septum 138. Mixed pharmaceutical 160 (that is the mixture of liquid 156 and hGH 158) passes from vial 10, through vial spike 120, into common region 132, through syringe needle cannula 166 and into syringe 164. When this occurs, the pressure within vial 10 and common region 132 is reduced. Therefore, some air is pulled from region 22 past check valve 118 (which provides some resistance to the flow of air) and into syringe 164 along with mixed pharmaceutical. To compensate for this, the health care worker withdraws more of mixed pharmaceutical 160 than is necessary, tilts syringe 164 so that needle end 162 angles upwardly (to collect the air at needle end 162) and then reinjects all of the air and some of the mixed pharmaceutical back into common region 132, through vial spike 120 and into the interior 154 of vial 10. Check valve 118 keeps the fluid from flowing into region 22 during this procedure. Alternatively, the health care worker can first inject some additional air into region 132 which then passes into vial interior 154. The air does not pass into region 22 since check valve 118 prevents the flow of fluid from common region 132 through valve spike 110. Subsequent withdrawals of fluid into syringe 164 will be all mixed pharmaceutical so long as the pressure within common region 132 is greater than within region 22. A combination of the two methods can also be used.

In use, vial 10 is mounted to device 2 by directing top 126 of the vial into recessed region 104 so that vial spike 120 passes through septum 128 of vial 10, thus securing vial 10 to device 2. Ampule 8 is mounted within open interior 46 of ampule housing 14 and twist barrel assembly 12 is driven downwardly over ampule housing 14 in the direction of arrow 62. Once threads 16, 18 are engaged, twist barrel assembly 12 is rotated as indicated by arrow 168 so to snap tip 64 from base 48 of ampule 8 and break bottom 53 of ampule 8 by driving the ampule onto post 50. During this movement, twist barrel assembly 12 and ampule housing 14 act as telescoping members moving from an extended position of FIG. 4 to a collapsed position of FIG. 5. Next, vial cup 92 and vial 10 therewith are moved in the direction of arrow 52 from the position of FIG. 5 to the position of FIG. 6 which allows liquid 156 within ampule 8 to automatically flow into vial 10 due to the pressure created in region 22 during the movement from the extended position of FIG. 4 to the collapsed position of FIG. 5. Device 2 is then inverted and mixed pharmaceutical 160 is withdrawn by inserting the needle end 162 of a syringe 164 into septum retainer 136. After a sufficient amount of mixed pharmaceutical 160 is aspirated into syringe 164, the syringe is removed from septum retainer 136 and the injection can be given.

It is seen that the present invention greatly simplifies the transfer of the contents of a glass ampule into a different container. Device 2 teaches a relatively simple procedure while enhancing safety and sterility. If desired, other types of containers other than vial 10 can be used. For example, a conventional cartridge of the type including a barrel, a moveable piston within the barrel and a needle-pierceable septum at one end could be used. In this case, after the cartridge-type container has been filled with mixed pharmaceutical 160, the cartridge-type container could be removed from the device and mounted within a conventional cartridge injector.

Other means for connecting region 22 to interior 154 of vial 10 can be used instead of the use of valve spike 110 and piercing septum 78. For example, a conventional valve could be used along the pathway connecting the two regions. Also, other methods for breaking ampule 8, such as inserting ampule 8 tip-down and driving tip 64 against an angled surface within ampule housing, could be used as well.

The preferred embodiment uses positive pressure in ampule region 22 to cause the flow of liquid 156 into interior 154 of vial 10. However, creating a partial vacuum in interior 154 of vial 10 would also work. Similarly, gravity flow could be used with appropriate venting of interior 154 and ampule region 22.

Other modifications and variations can be made to the disclosed embodiment without departing from the subject of the invention as defined in the following claims.

What is claimed is:

1. A device for containing and opening a glass ampule containing a liquid, and for transferring a portion of the liquid to the interior of a container, the ampule including a base, a tip and a neck therebetween, the device comprising;

an ampule containing a liquid and having a base, a tip, and a neck therebetween;

a container having an interior containing a pharmaceutical component, the pharmaceutical component being a substrate other than the liquid;

means for increasing the pressure in the region to a pressure above ambient pressure a body to which the container is mountable;

means, coupled to the body, for housing the ampule in a region;

means for breaking the ampule so that the liquid in the ampule flows into the region;

means for fluidly coupling the region to the interior of the container along a flow path so that the liquid in the region flows into the interior of the container; and a pierceable septum positioned along the fluid path for fluidly accessing the interior of the container, the pierceable septum being exposed so that a syringe may be used to pierce the septum and extract a liquid mixture from the container.

2. A method for transferring at least a portion of a liquid contained within a glass ampule to the interior of a container, the ampule including a base, a tip and a neck therebetween, the method comprising the following steps:

housing an ampule in a region of a body, the ampule containing a liquid;

coupling a container to the body, the container having an interior containing a pharmaceutical component, the interior of the container occupying a space which is independent and separate from the region in which the ampule is housed;

increasing the pressure in the region to a pressure above ambient pressure;

breaking the ampule so that the liquid in the ampule flows into the region; and fluidly coupling the region to the interior of the container along a flow path so that the liquid in the region flows into the interior of the container under the influence of the pressure above ambient pressure.

3. The method of claim 2 wherein: the pressure increasing step is carried out with a telescoping structure and collapsing the telescoping structure over the ampule to create a positive pressure within the region.

4. The method of claim 2 wherein: the ampule breaking step includes snapping off the tip of the ampule and breaking the base of the ampule.

5. The method of claim 2 further comprising: filtering the liquid as the liquid flows along the flow path.

6. The method of claim 2 further comprising: preventing fluid flow along the flow path from the container to the region.

7. The method of claim 2 further comprising:

fluidly accessing the interior of the container through a syringe septum positioned along the flow path while the container remains coupled to the body; and preventing a fluid flow from the region to the second position along the fluid path during fluidly accessing of the interior of the container.

8. A device for opening a glass ampule, containing a liquid, and transferring at least part of the liquid to a vial, the ampule including a tip, a base, and a neck therebetween, the vial including a pierceable vial septum and an interior containing a pharmaceutical component, the device comprising:

a vial including a pierceable vial septum and an interior containing a pharmaceutical component;

an ampule containing a liquid and having a base, a tip, and a neck therebetween;

a body defining a collapsible, substantially air-tight region therein, the ampule being housed within the region of the body, the body including first and second telescoping elements movable from an extended position to a collapsed position thereby reducing the size of the region so as to increase the pressure in the region;

means for breaking the ampule within the region;

a vial body, mountable to the body, including a vial spike for piercing the vial septum when the vial is mounted to the vial body; and the body and the vial body defining a selectively openable flow path which is selectively opened so that the liquid in the region will flow from the region, through the flow path, through the vial spike and into the vial.

9. The device of claim 8 wherein: the ampule breaking means includes an eccentric member carried by the first telescoping part and a post carried by the second telescoping part, the eccentric member engagable with the tip and the post engagable with the base of the ampule.

10. The device of claim 8 further comprising: means for accessing the contents of the vial through the vial spike.

11. The device of claim 8 further comprising: a filter along the flow path.

12. The device of claim 8 further comprising: a one-way valve at a first position along the flow path.

13. The device of claim 12 further comprising: a syringe access device including a syringe septum at a second position along the flow path between the first position and the vial spike to permit fluid access to the vial through said syringe septum.

14. An ampule containing, opening and transferring device comprising:

an ampule containing a liquid, the ampule having a base, a tip, and a neck therebetween;

a container having an interior containing a pharmaceutical component, the pharmaceutical component being a substance other than the liquid;

a body to which the container is mountable;

means, coupled to the body, for housing the ampule in a region;

means for increasing the pressure in the region to a pressure above ambient pressure;

means for breaking the ampule so that the liquid in the ampule flows into the region;

means for fluidly coupling the region to the interior of the container along a flow path so that the liquid in the region flows into the interior of the container under the influence of the pressure above ambient pressure thereby mixing the liquid and the pharmaceutical component; and means for filtering a fluid flow along the flow path.

15. The device of claim 14 wherein: the pressure increasing means includes a telescoping element, mountable over the ampule, movable from an extended position to a collapsed position so that the volume of the region decreases thereby increasing the pressure within the region to the pressure above ambient pressure.

16. The device of claim 15 wherein: the ampule breaking means includes means, carried by the telescoping element, for applying a lateral force on the ampule as the telescoping element moves from the extended position to the collapsed position.

17. The device of claim 16 wherein: the ampule breaking means includes means for breaking a base of the ampule as the telescoping element moves from the extended position to the collapsed position.

18. The device of claim 1 wherein: the fluidly coupling means includes a pierceable septum positioned along the flow path.

19. The device of claim 18 wherein: the flow path is defined in part by a hollow valve spike having a sharpened end, used to pierce the septum, and an exit end.

20. The device of claim 19 wherein: the flow path includes a check valve which permits fluid flow from the region to the interior of the container but prevents fluid flow from the interior of the container to the region.

21. The device of claim 20 wherein: the check valve includes a flap of flexible material positioned adjacent the hollow valve spike at the exit end.

22. The device of claim 19 wherein: the flow path is defined in part by a hollow vial spike having a sharpened vial end and an entrance end.

23. The device of claim 22 wherein: the exit end and the entrance end open into a common region.

* * * * *